US009025776B2

(12) United States Patent
Xiang et al.

(10) Patent No.: US 9,025,776 B2
(45) Date of Patent: May 5, 2015

(54) DECORRELATING AUDIO SIGNALS FOR STEREOPHONIC AND SURROUND SOUND USING CODED AND MAXIMUM-LENGTH-CLASS SEQUENCES

(75) Inventors: Ning Xiang, Cohoes, NY (US); Bosun Xie, GuangDong (CN); Bei Shi, GuangDong (CN)

(73) Assignee: Rensselaer Polytechnic Institute, Troy, NY (US)

( * ) Notice: Subject to any disclaimer, the term of this patent is extended or adjusted under 35 U.S.C. 154(b) by 408 days.

(21) Appl. No.: 13/522,750

(22) PCT Filed: Jan. 31, 2011

(86) PCT No.: PCT/US2011/023151
§ 371 (c)(1),
(2), (4) Date: Sep. 12, 2012

(87) PCT Pub. No.: WO2011/094675
PCT Pub. Date: Aug. 4, 2011

(65) Prior Publication Data

US 2012/0328110 A1 Dec. 27, 2012

Related U.S. Application Data

(60) Provisional application No. 61/337,209, filed on Feb. 1, 2010.

(51) Int. Cl.
*H04R 5/00* (2006.01)
*G10L 21/00* (2013.01)

(52) U.S. Cl.
CPC ..... *G10L 21/00* (2013.01)

(58) Field of Classification Search
CPC ..... H04R 5/00
USPC ..... 381/1, 17–18, 61, 22
See application file for complete search history.

(56) References Cited

U.S. PATENT DOCUMENTS

| | | | | |
|---|---|---|---|---|
| 7,702,245 | B1 * | 4/2010 | Mork et al. | 398/183 |
| 8,170,882 | B2 * | 5/2012 | Davis | 704/500 |
| 8,213,621 | B2 * | 7/2012 | Bruno et al. | 381/17 |
| 2006/0165184 | A1 | 7/2006 | Purnhagen et al. | |

(Continued)

FOREIGN PATENT DOCUMENTS

| | | |
|---|---|---|
| KR | 10-2007-0094422 | 9/2007 |
| WO | WO 2008/096313 A1 | 8/2008 |

OTHER PUBLICATIONS

International Preliminary Report on Patentability issued for PCT Application No. PCT/US2011/023151 mailed Aug. 16, 2012.

(Continued)

*Primary Examiner* — Disler Paul
(74) *Attorney, Agent, or Firm* — RatnerPrestia

(57) ABSTRACT

Methods and systems for processing an audio signal are provided. The method includes generating a pseudorandom sequence and generating at least one reciprocal of the pseudorandom sequence such that the at least one reciprocal is substantially decorrelated with the pseudorandom sequence. The pseudorandom sequence and the at least one reciprocal form a set of sequences. The method further includes convolving the audio signal with the set of sequences to generate a corresponding number of output signals and providing the number of output signals to a corresponding number of loudspeakers.

19 Claims, 9 Drawing Sheets

(56) References Cited

U.S. PATENT DOCUMENTS

| | | | | |
|---|---|---|---|---|
| 2007/0189426 | A1 | 8/2007 | Kim et al. | |
| 2008/0031463 | A1* | 2/2008 | Davis | 381/17 |
| 2010/0119075 | A1* | 5/2010 | Xiang et al. | 381/63 |

OTHER PUBLICATIONS

International Search Report for PCT International Application No. PCT/US2011/023151 mailed Sep. 27, 2011.

* cited by examiner

DECORRELATING AUDIO SIGNALS FOR STEREOPHONIC AND SURROUND SOUND USING CODED AND MAXIMUM-LENGTH-CLASS SEQUENCES

CROSS REFERENCE TO RELATED APPLICATIONS

This application a U.S. National Phase Application of PCT International Application No. PCT/US2011/023151, filed Jan. 31, 2011 and claims the benefit of U.S. Provisional Application No. 61/337,209 entitled DECORRELATING AUDIO SIGNALS FOR STEREOPHONIC AND SURROUND SOUND USING CODED AND MAXIMUM-LENGTH-CLASS SEQUENCES filed on Feb. 1, 2010, the contents of which are incorporated herein by reference.

FIELD OF THE INVENTION

The present invention relates to the field of audio signal processing and, more particularly, to methods and apparatus for generating decorrelated audio signals using coded sequences.

BACKGROUND OF THE INVENTION

Decorrelation of audio signals is known. Conventionally, decorrelation of an audio signal involves transforming the audio signal into multiple signals. Each of the transformed signals sound substantially the same as the original audio signal, but have different waveforms and have a reduced correlation with respect to each other (i.e., a low cross-correlation). The low cross-correlation between the transformed signals results in a perceived sense of listener envelopment and spatial immersion. In general, listener envelopment and spatial immersion is referred to as spaciousness.

Decorrelation of audio signals is typically included in audio reproduction, such as for stereophonic and multi-channel surround sound reproduction (e.g., 5.1 channel and 7.1 channel surround sound reproduction). In conventional decorrelation techniques, signals with low cross-correlation are typically used to recreate the perception of spaciousness. The conventional signals, however, may introduce timbre coloration (because the cross-correlation between the random phase signals may not be substantially flat over the frequency spectrum). Conventional techniques may also be computationally expensive to implement. Accordingly, it may be desirable to provide an apparatus and method for decorrelation of audio signals that does not introduce coloration and is computationally inexpensive.

SUMMARY OF THE INVENTION

The present invention is embodied in methods for processing an audio signal. The method includes generating a pseudorandom sequence and generating at least one reciprocal of the pseudorandom sequence such that the at least one reciprocal is substantially decorrelated with the pseudorandom sequence. The pseudorandom sequence and the at least one reciprocal form a set of sequences. The method further includes convolving the audio signal with the set of sequences to generate a corresponding number of output signals and providing the number of output signals to a corresponding number of loudspeakers.

The present invention is also embodied in audio signal processing apparatus. The audio signal processing apparatus includes a coded sequence generator configured to generate a pseudorandom sequence and a signal decorrelator. The signal decorrelator is configured to generate at least one reciprocal of the pseudorandom sequence such that the at least one reciprocal is substantially decorrelated with the pseudorandom sequence. The pseudorandom sequence and the at least one reciprocal form a set of sequences. The signal decorrelator modifies an audio signal by the set of sequences to produce a corresponding number of output signals.

The present invention is also embodied in a system for processing an audio signal. The system includes a decoder configured to receive an input audio signal and to generate at least three channels of output signals. The system also includes an audio signal processing apparatus configured to receive the input audio signal and to generate at least two pseudorandom sequences that are substantially decorrelated with each other. The audio signal processing apparatus modifies the input audio signal by the at least two pseudorandom sequences to produce at least two decorrelated signals.

BRIEF DESCRIPTION OF THE DRAWINGS

The invention may be understood from the following detailed description when read in connection with the accompanying drawings. It is emphasized that, according to common practice, various features/elements of the drawings may not be drawn to scale. On the contrary, the dimensions of the various features/elements may be arbitrarily expanded or reduced for clarity. Moreover, in the drawings, common numerical references are used to represent like features/elements. Included in the drawing are the following figures.

DETAILED DESCRIPTION OF THE INVENTION

Figure 1:
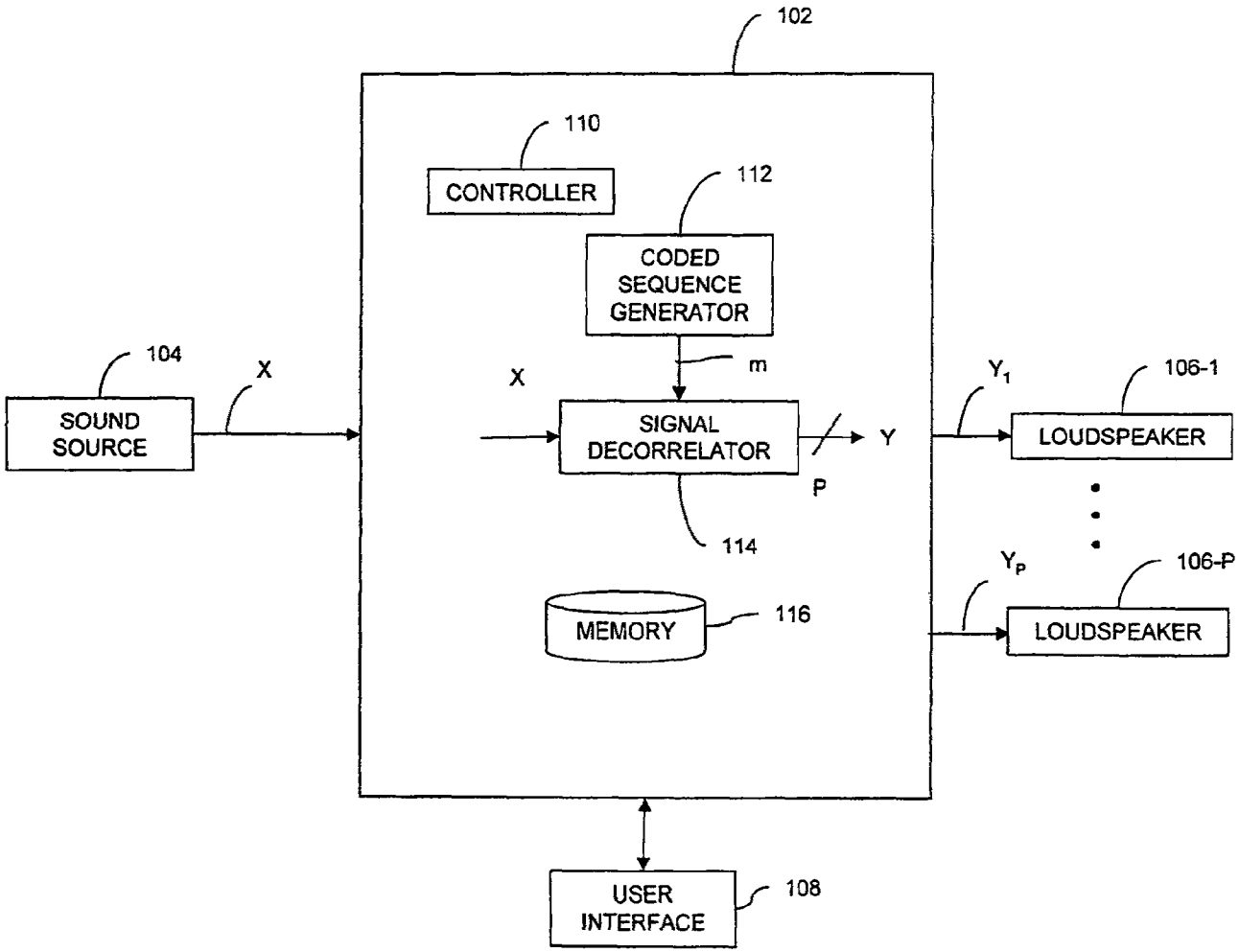
FIG. 1 is a functional block diagram illustrating an exemplary audio signal processing apparatus for generating decorrelated audio signals, according to an embodiment of the present invention.

As discussed above, in conventional stereophonic and surround sound systems, signals with low correlation are typically used for two or more of the loudspeakers, in order to recreate a perception of envelopment and spatial immersion. These conventional signals are typically signals with a random phase response (referred to herein as random phase signals).

The cross-correlation of random phase signals, however, is typically not repeatable, particularly at low frequencies (i.e., below about 1.5 kHz). Accordingly, it may be difficult to generate a controllable low cross-correlation response over time (i.e. with a flat spectrum) using random phase signals. In addition, the cross-correlation response (e.g., between a pair of stereophonic signals or surround sound signals), at low frequencies, typically provides a greater influence on the perception of spaciousness and the localization of auditory events. Accordingly, random phase signals may introduce a timbre coloration to the transformed audio signals. Because it may be difficult to generate reproducible low cross-correlation with random phase signals, these conventional methods typically have an increased processing complexity.

Aspects of the present invention relate to methods and apparatus for audio signal processing to produce substantially decorrelated audio signals. According to an exemplary method of the present invention, a set of reciprocal pseudorandom sequences is generated, where the reciprocal pseudorandom sequences are substantially decorrelated with one another. The set of reciprocal pseudorandom sequences is convolved with an audio signal, to produce a corresponding set of decorrelated audio signals. The decorrelated audio signals may be used for stereophonic or multichannel surround sound reproduction.

Because the present invention uses pseudorandom sequences, these sequences are reproducible and easily controllable. As described further below, by generating reciprocal pseudorandom sequences (e.g., time-reversed versions of an initial pseudorandom sequence), the cross-correlation is substantially reduced across the frequency spectrum. Thus, exemplary decorrelation methods may generate a more effective spaciousness and a perception of broader auditory events as compared with conventional random phase methods. Accordingly, exemplary decorrelation methods of the present invention may produce a more effective decorrelation as compared with conventional random phase methods.

Advantages of the present invention include the use of a monophonic audio signal (i.e., a pseudorandom sequence) to widen and diffuse a perception of auditory events (associated with the apparent source width (ASW)), which may substantially reduce an instrumentation cost for a decorrelation apparatus. The monophonic signal may be decorrelated into two or more signals of mutually low correlation, without timbre coloration. Accordingly, exemplary decorrelation methods of the present invention may have reduced processing complexity, and may be easily implemented in real-time systems. Exemplary decorrelation methods may be applied to stereophonic and multi-channel surround systems, such as 5.1 and 7.1 surround sound systems.

Referring next to FIG. 1, a functional block diagram of exemplary audio signal processing apparatus 102 is shown for decorrelating an audio signal, designated as X, from sound source 104. Apparatus 102 includes controller 110, coded sequence generator 112, signal decorrelator 114 and memory 116. Apparatus 102 generates a P number of decorrelated signals, designated as Y, and provides decorrelated signals to a corresponding P number of loudspeakers 106. P represents a positive integer greater than or equal to 2. Apparatus 102 may include other electronic components and software suitable for performing at least part of the functions of decorrelating audio signal X.

Sound source 104 may include any sound source capable of providing a monophonic or stereophonic audio signal X. Audio signal X may include a bit stream, such as an MP3 bit stream. Audio signal X may also include parametric information for generating signals for a left channel, a right channel and a center channel of a multi-channel surround sound system.

Apparatus 102 may be coupled to a P number of loudspeakers 106 for outputting the P number of decorrelated signals Y. Loudspeakers 106 may include any loudspeaker capable of reproducing respective decorrelated signals $Y_1, \ldots, Y_p$.

Coded sequence generator 112 may be configured to generate a pseudorandom sequence m having a predetermined sequence length N. The pseudorandom sequence m is provided to signal decorrelator 114 for generating decorrelated signals Y. According to an exemplary embodiment, pseudorandom sequence m includes a maximum-length sequence (MLS).

Figure 2:
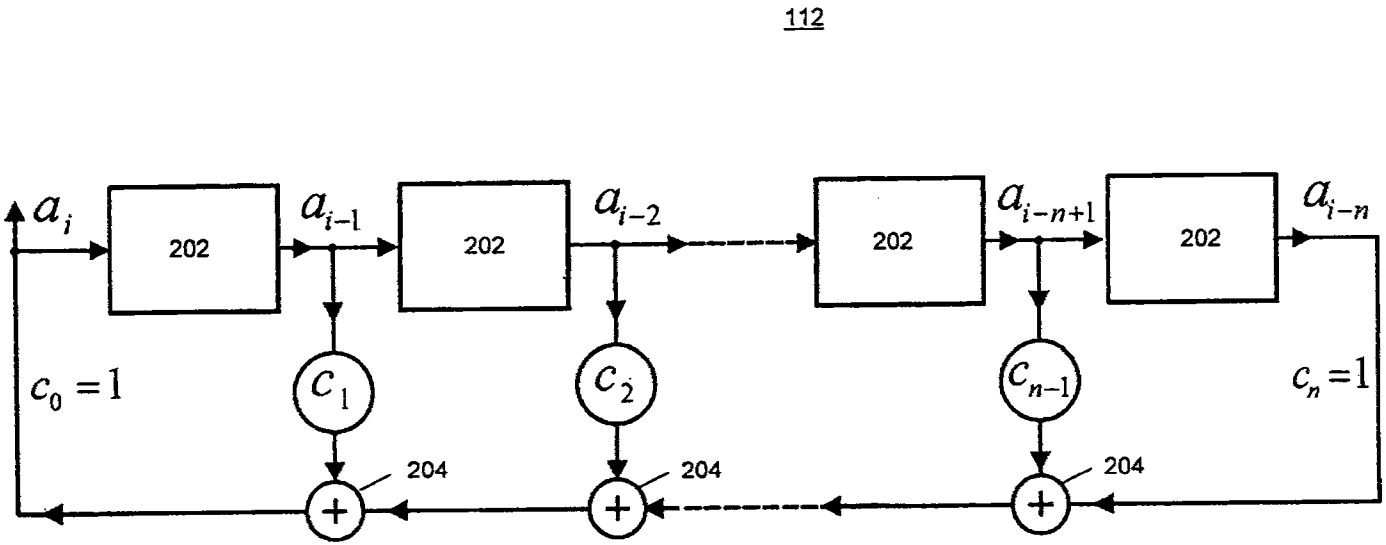
FIG. 2 is a functional block diagram illustrating an example coded sequence generator included in the audio signal processing apparatus shown in FIG. 1.

Referring to FIG. 2, an example coded sequence generator 112 for generating an MLS is shown. Example generator 112 includes a plurality of storage units 202 for storing respective coefficients $a_i, \ldots, a_{i-n+1}$ (i.e., as contents of respective storage units 202) and summer blocks 204 for combining feedback coefficients $C_1, \ldots, C_{n-1}$. Feedback coefficients $C_0, \ldots, C_n$ are either 0 or 1 and form the pseudorandom sequence m. Storage units 202 may include, for example, memory devices or flip-flops. Summer blocks 204 may perform modulo-2 addition or an exclusive OR logical operation. According to one embodiment, example generator 112 may be implemented by a linear feedback shift-register of length n (also referred to herein as the degree of the sequence). The sequence length N is related to the shift-register length as $N=2^n-1$. According to another embodiment, an MLS may be generated by linear recursion. It is understood that FIG. 2 represents an exemplary embodiment of coded sequence generator 112, and that coded sequence generator 112 may generate a pseudorandom sequence using any suitable electronic components and/or using software.

Figure 3:
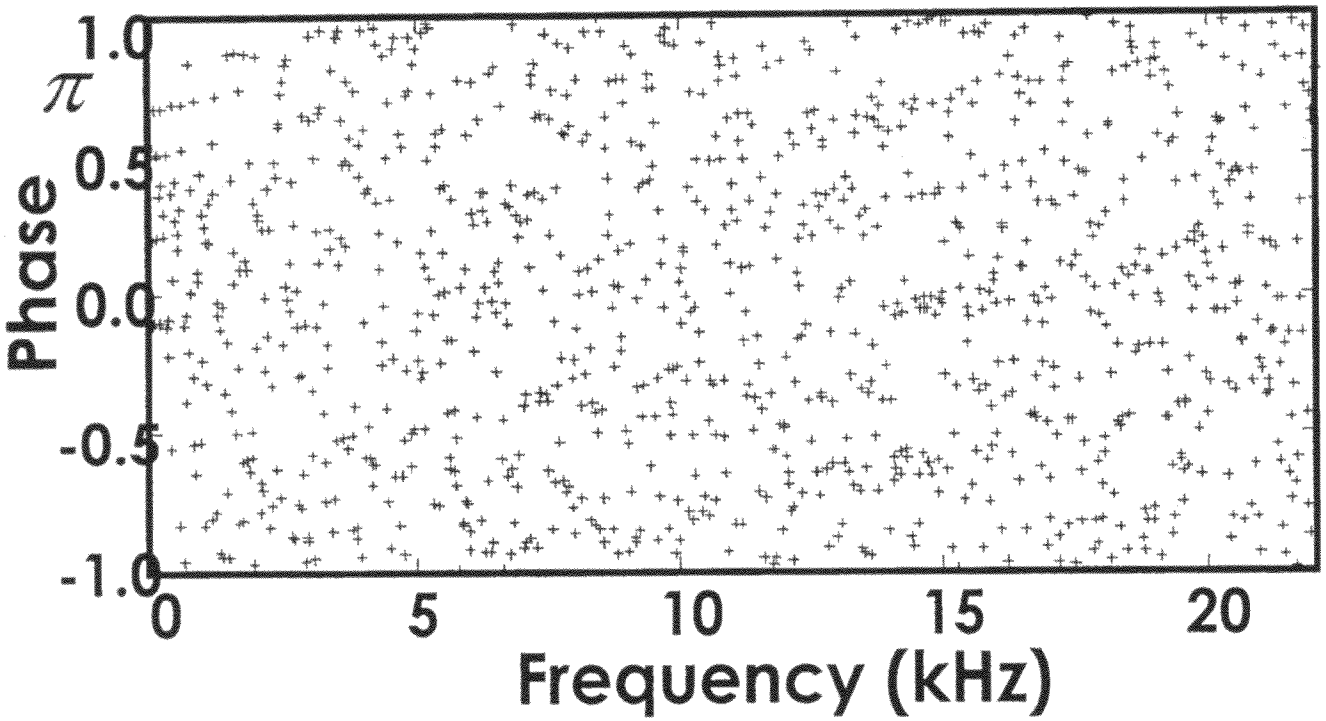
FIG. 3 is a graph of an example phase spectrum of a maximum length sequence (MLS) generated by the example coded sequence generator shown in shown in FIG. 2.
Figure 4:
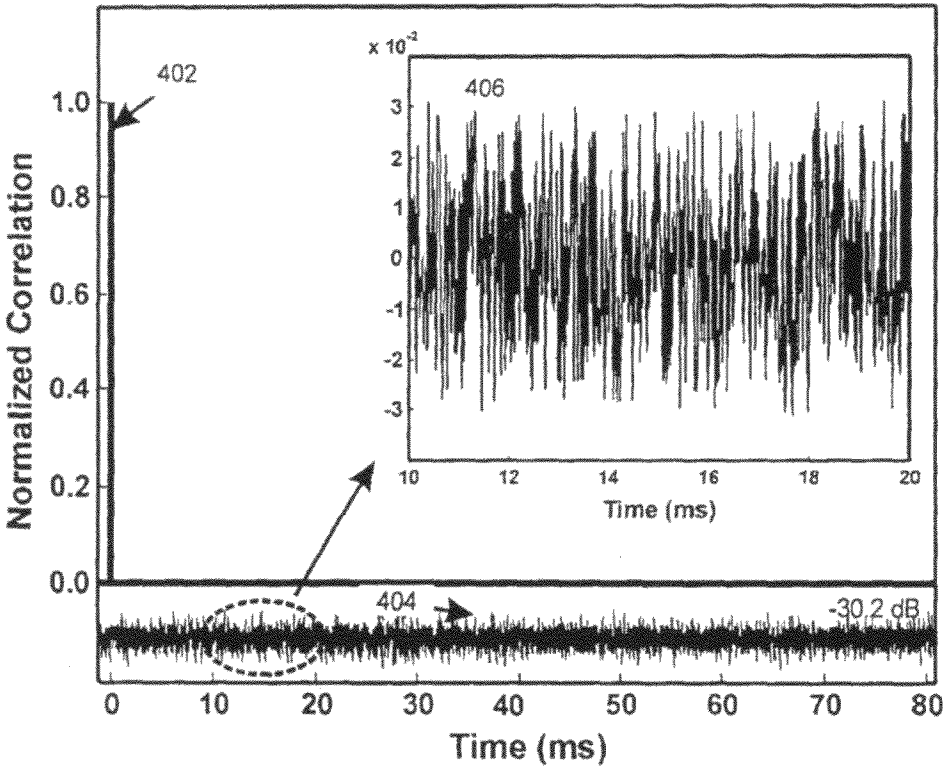
FIG. 4 is a graph of an example autocorrelation of an MLS sequence and an example cross-correlation between a reciprocal MLS pair generated by the exemplary audio signal processing apparatus shown in FIG. 1.

MLSs are generally referred to as being pseudorandom, because they possesses a random nature, similar to random noise, but are periodic and deterministic. MLSs possess a pulse-like autocorrelation function. They include a substantially flat and broadband power spectrum. MLSs, however, possess a highly random phase-spectrum. Referring to FIG. 3, an exemplary phase spectrum of a maximum length sequence (MLS) is shown, illustrating the random nature of the phase spectrum. Referring to FIG. 4, an exemplary autocorrelation 402 (also referred to herein as correlation function 402) of an MLS of degree n=12 generated at a sampling frequency of 50 kHz is shown. Correlation function 402 illustrates the pulse-like nature of the MLS autocorrelation, which corresponds to a substantially flat power spectrum. Because the power spectrum is flat, no coloration is introduced by the MLS.

Although the coded sequence generator 112 shown in FIG. 2 illustrates generation of an MLS, coded sequence generator 112 may generate any suitable MLS-related sequence, where the sequence possesses a pulse-like periodic autocorrelation function and where a periodic cross-correlation function between any pair of sequences includes peak values that is significantly lower than the peak value of the autocorrelation function. Other exemplary sequences include, for example, Gold sequences and Kasami sequences.

Referring back to FIG. 1, signal decorrelator 114 may be configured to receive pseudorandom sequence m and generate a set of pseudorandom sequences. Signal decorrelator 114 may also receive audio signal X and may modify audio signal X with the set of pseudorandom sequences, to generate decorrelated signals Y. Signal decorrelator 114 is described further below with respect to FIG. 5.

Memory 116 may store the set of pseudorandom sequences generated by signal decorrelator 114. Memory 116 may also store a number of predetermined sequence lengths for generating pseudorandom sequence m. The sequence lengths may be selected to produce a suitable broadening of auditory events, as described further below. Memory 116 may additionally store a plurality of spatial shaping coefficients for a plurality of predetermined enclosures, described further below with respect to FIG. 6. Memory 116 may be a magnetic disk, a database or essentially any local or remote device capable of storing data.

Controller 110 may be a conventional digital signal processor that controls generation of decorrelated signals Y in accordance with the subject invention. Controller 110 may be configured to control coded sequence generator 112, signal decorrelator 114 and memory 116. Controller 110 may also control the reception of audio signal X and the transmission of decorrelated signals Y from apparatus 102 to corresponding loudspeakers 106. Controller 110 may be configured to select a sequence length from memory 116 for generating pseudorandom sequence m. Controller 110 may also be configured to select spatial shaping coefficients from memory 116 which may be applied to the set of pseudorandom sequences.

Apparatus 102 may optionally include user interface 108, e.g., for use in selecting a sequence length and/or spatial shaping coefficients to generate decorrelated signals Y. User interface 108 may include any suitable interface, such as a pointing device type interface for selecting the sequence length and/or coefficients using a display (not shown), for selecting a sequence length and/or spatial shaping coefficients.

A suitable sound source 104, loudspeakers 106, controller 110, coded sequence generator 112, signal decorrelator, memory 116 and user interface 108 for use with the present invention will be understood by one of skill in the art from the description herein.

Figure 5:
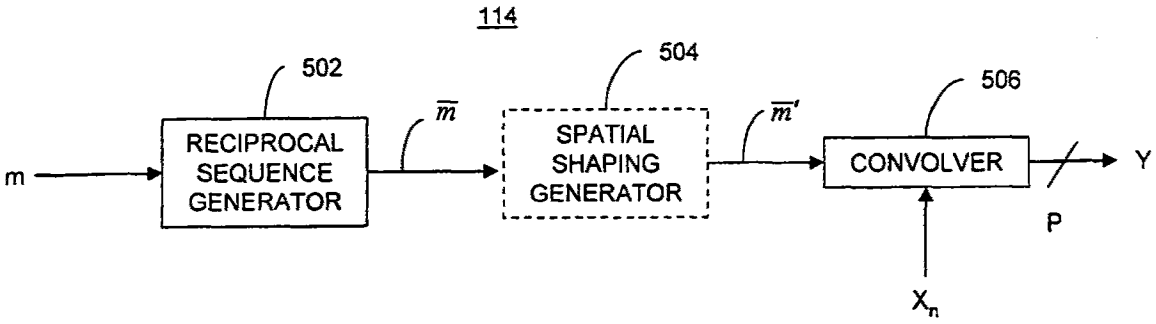
FIG. 5 is a functional block diagram illustrating an exemplary signal decorrelator included in the audio signal processing apparatus shown in FIG. 1, according to an embodiment of the present invention.

Referring next to FIG. 5, a functional block diagram of exemplary signal decorrelator 114 is shown. Signal decorrelator 114 includes reciprocal sequence generator 502 and convolver 506. Signal decorrelator 114 may also include optional spatial shaping generator 504.

Reciprocal sequence generator 502 receives pseudorandom sequence m from coded sequence generator 112 (FIG. 1) and generates a set of pseudorandom sequences, referred to as $\overline{m}$. In general, set $\overline{m}$ includes pseudorandom sequence m and at least one reciprocal of pseudorandom sequence m. For example, if a single reciprocal is generated, set $\overline{m}$ may be referred to as a reciprocal pair, and may be referred to by equation (1) as:

$$\overline{m}=[m(t),m_R(t)] \tag{1}$$

where m(t) represents the pseudorandom sequence m and $m_R(t)$ represents a reciprocal pseudorandom sequence. In general, any number of sources $m_v(t)=m(t)\ m_R(t+v)$ may be used, where v is an integer greater than or equal to 1.

According to one embodiment, a reciprocal pseudorandom sequence may be obtained from a time-reversed version of m(t), such that $m_R(t)=m(-t)$. Reciprocal pairs of MLS sequences may be easily generated, via time-reversal. According to another embodiment, the reciprocal pseudorandom sequence may be generated by a decimation of pseudorandom sequence m by a decimation factor q. Decimation factor q may be represented by equation (2) as:

$$q=2^{(n-1)} \tag{2}$$

where n is the degree of pseudorandom sequence m.

In this manner, a large number of sequences may be generated, from among which any reciprocal pair possesses a low-valued cross-correlation. Examples of generating reciprocal MLS-related sequences may be found, for example, in Xiang et al., entitled "Simultaneous acoustic channel measurement via maximal-length-related sequences," JASA vol. 117 no. 4, April 2005, pp. 1889-1894 and Xiang et al., entitled "Reciprocal maximum-length sequence pairs for acoustical dual source measurements," JASA vol. 113 no. 5, May 2003, pp. 2754-2761, the contents of which are incorporated herein by reference.

An advantage of reciprocal M-type sequences is that they include cross-correlation values that are sufficiently low, which allow for the creation of a maximum desired perceived spaciousness. Referring to FIG. 4, an exemplary cross-correlation 404 between a reciprocal MLS pair of degree n=12 generated at a sampling frequency of 50 kHz is shown. As indicated in insert 406 of FIG. 4, cross-correlation values 404 are substantially low values. FIG. 4 also illustrates autocorrelation 402 of the MLS of degree n=12, as described above. In FIG. 4, cross-correlation 404 is shifted below autocorrelation 402, for ease of comparison. Both autocorrelation 402 and cross-correlation 404 are shown on a same amplitude scale. The peak value of cross-correlation 404 (as shown in insert 406) is about 0.03, or about 30.2 dB lower than the peak value of autocorrelation 402. In general, exemplary reciprocal MLSs and reciprocal MLS-related sequences are able to achieve a much broader apparent source width and spaciousness as compared with conventional random phase methods.

The cross-correlation values 404 (associated with spaciousness) may be related to the degree of the MLS, according to equation (3) as:

$$\phi(n)=\frac{2^{(n+2)/2}-1}{2^n-1} \tag{3}$$

Accordingly, the amount of perceived spaciousness may be adjusted based on the degree n of the MLS. The sequence length N (which is related to degree n) may thus be selected to achieve a desired spaciousness and for a suitable technical implementation. According to an exemplary embodiment, sequence length N (for MLSs) may be selected to be between 511 and 4095. According to another embodiment, different degrees of spaciousness may also be generated by mixing together two or more of the MLSs or MLS-related sequences.

Referring back to FIG. 5, signal decorrelator 114 may optionally include spatial shaping generator 504. Spatial shaping generator 504 receives a set of pseudorandom sequences $\overline{m}$ and generates a spatially shaped set of signals, $\overline{m}'$. In general, set of sequences $\overline{m}$ may be mixed by predetermined attenuation coefficients, described further below with respect to FIG. 6; to provide a desired degree of spaciousness. In audio signal decorrelation, it is typically desired to generate a maximum perceived spaciousness. Optional spatial shaping generator 504 may be included in signal decorrelator 114, however, to allow for a reduction in the degree of perceived spaciousness.

Figure 6:
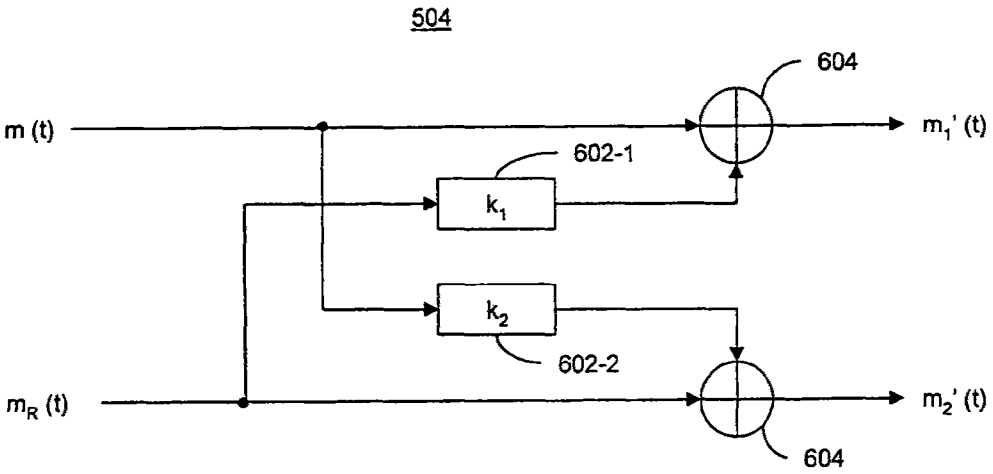
FIG. 6 is a functional block diagram illustrating an exemplary spatial shaping generator, according to an embodiment of the present invention.

Referring to FIG. 6, spatial shaping generator 504 includes attenuation blocks 602-1, 602-2 for the respective channels and summer blocks 604. For a two channel system, for example, the spatially shaped signals $\overline{m}'$ may be represented as:

$$m_1'(t)=k_1m_R(t)+m(t)$$

$$m_2'(t)=k_2m(t)+m_R(t) \tag{4}$$

where $\overline{m}'=[m_1'(t),m_2^1(t)]$, k represents the attenuation coefficient for the respective channel and $0 \leq k < 1$. Typically, $k_1$ is set equal to $k_2$, so that the spaciousness is balanced and the auditory event is not perceived as being shifted to a particular side.

As shown in FIG. 6, pseudorandom sequence m(t) is multiplied by attenuation coefficient 602-2 ($k_2$) and reciprocal sequence $m_R(t)$ is multiplied by attenuation coefficient 602-1 ($k_1$), to form the signals shown in equation (4). Pseudorandom sequence m(t) is summed with the attenuated reciprocal sequence $m_R(t)$ to form spatially shaped signal $m_1'(t)$ via summer block 604. Reciprocal sequence $m_R(t)$ is summed with the attenuated pseudorandom sequence m(t) to form spatially shaped signal $m_2'(t)$ via summer block 604.

Each of attenuation coefficients $k_1$ and $k_2$ may be selected to match a predetermined spaciousness for one of a plurality of enclosures and to control the amount of perceived spaciousness for the decorrelated signals Y (FIG. 5).

Equation (4) may be rewritten in matrix form as:

$$\begin{bmatrix} m_1' \\ m_2' \end{bmatrix}_m = \overbrace{\begin{bmatrix} 1 & k \\ k & 1 \end{bmatrix}}^{mixing\ matrix}_m \cdot \begin{bmatrix} m(t) \\ m_R(t) \end{bmatrix}_m \tag{5}$$

where the attenuation coefficients may be formulated as a mixing matrix. In equation (5) the individual attenuation coefficient subscripts have been dropped.

In general, combining two channels together (i.e. combining m(t) and $m_R(t)$) tends to decrease a perceived spaciousness. Accordingly, if the attenuation coefficient k was set to 1, $B_1(t)$ would be maximally combined with $B_2(t)$, and there would be no perceived spaciousness for the channel. In contrast, if the attenuation coefficient k is set to 0, only one sequence is passed (i.e., m(t) or $m_R(t)$ depending on the channel in equation (4)), and there is high perceived spaciousness for the channels.

Although FIG. 6 illustrates an example of a two channel spatial shaping generator 504, spatial shaping generator 504 may be applied to multiple channels. According to another embodiment, spatial shaping generator 504 may apply spatial shaping to any multiple number of channels L to provide an L×L-sized mixing matrix. For example, a four channel mixing matrix may be represented as:

$$\begin{bmatrix} m_1' \\ m_2' \\ m_3' \\ m_4' \end{bmatrix}_m = \begin{bmatrix} 1 & k & k & k \\ k & 1 & k & k \\ k & k & 1 & k \\ k & k & k & 1 \end{bmatrix}_m \cdot \begin{bmatrix} m_1(t) \\ m_2(t) \\ m_3(t) \\ m_4(t) \end{bmatrix}_m \tag{6}$$

The mixing matrix may be selected to substantially match a spatial index for a predetermined enclosure, as described above.

Referring back to FIG. 5, signal decorrelator 114 includes convolver 506 for convolving audio signal X with set of pseudorandom sequences $\overline{m}$ (or, optionally, set of spatially modified pseudorandom sequences $\overline{m}'$), to form a corresponding number P of decorrelated signals Y. As known by the skilled person, the convolution may be performed in the time domain or in the frequency domain. The convolution may be performed by finite impulse response (FIR) filtering of the set of pseudorandom sequences $\overline{m}$ (or, optionally, the set of spatially modified pseudorandom sequences $\overline{m}'$) with audio signal X. An exemplary technique for performing the FIR filtering using pseudorandom sequences is described in Daigle et al., "A specialized fast cross-correlation for acoustical measurements using coded sequences," J. Acoustical Society of America, vol. 119, no. 1, January 2006, pages 330-335, the contents of which are incorporated herein.

Figure 7:
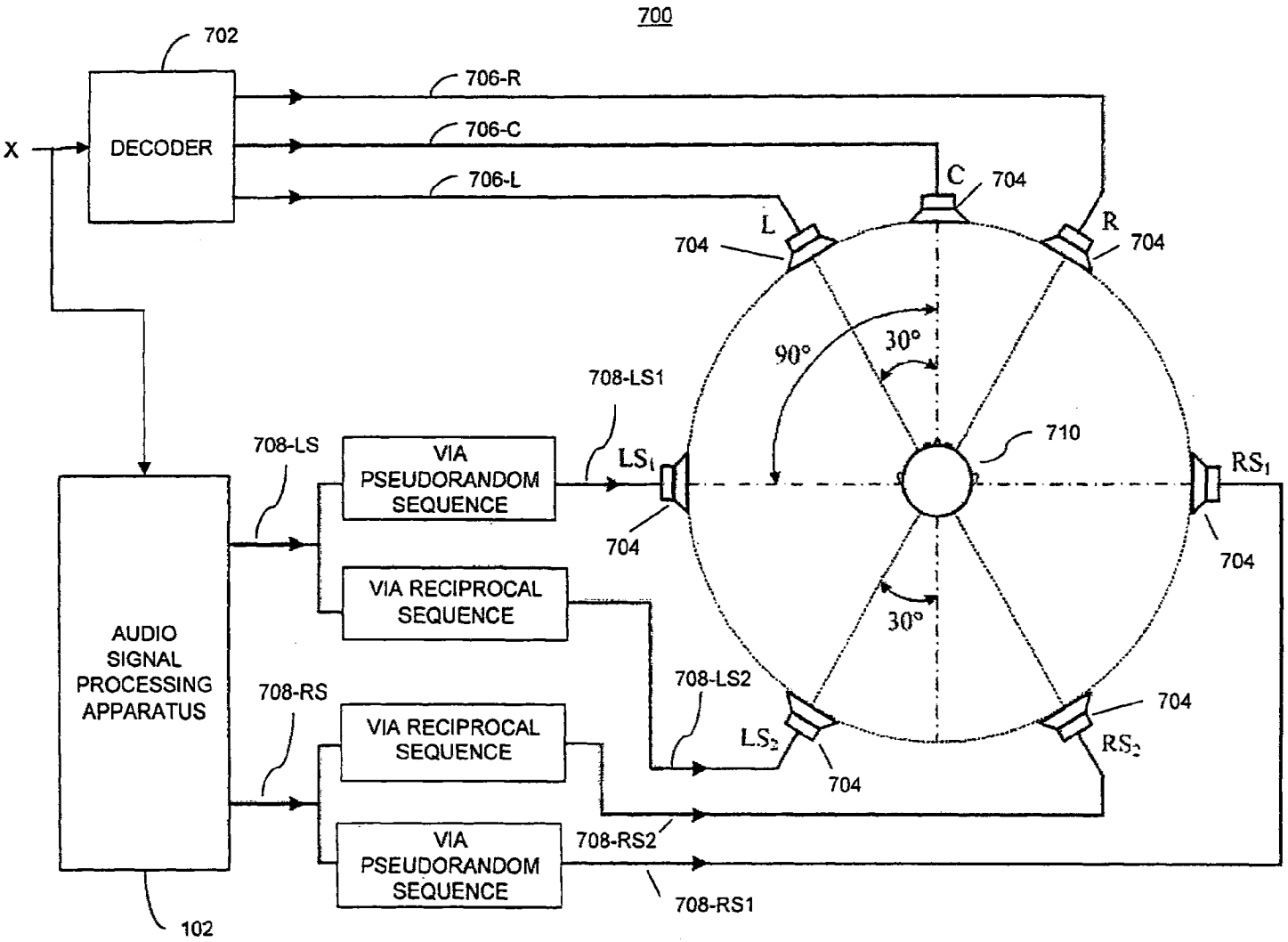
FIG. 7 is a functional block diagram illustrating an exemplary system for processing an audio signal, according to another embodiment of the present invention.

Referring to FIG. 7, a functional block diagram of exemplary system 700 for processing an audio signal X to provide multi-channel surround sound reproduction, according to an embodiment of the present invention is illustrated. System 700 includes decoder 702 and audio signal processing apparatus 102 coupled to respective loudspeakers 704. Loudspeakers 704 are arranged around listener 710 for a best suitable spatial hearing impression. System 700 represents a 7.1 channel system (where the 0.1 subwoofer channel is not shown). It is understood that system 700 represents one example of a multi-channel surround sound system and that aspects of the invention are also applicable to 5.1 channel surround sound systems and any general multiple channel surround sound system.

Decoder 702 receives audio signal X, for example, from sound source 104 (FIG. 1) and generates signals 706-R, 706-C, 706-L for respective right (R), center (C) and left (L) channels of system 700. Decoder 702 may also use parametric information included in audio signal X to generate the right, center and left channel signals 706-R, 706-C, 706-L. A suitable decoder 702 may be understood by one of skill in the art from the description herein.

Audio signal processing apparatus 102, provides decorrelated signals 708-LS1, 708-LS2, 708-RS1, 708-RS2 to respective loudspeakers 704 of the corresponding left surround channels ($LS_1$, $LS_2$) and right surround channels ($RS_1$, $RS_2$). Decorrelated signals 708-LS1 and 708-LS2 include one reciprocal pair of pseudorandom sequences (as discussed above with respect to FIG. 5) and decorrelated signals 708-RS1 and 708-RS2 include another reciprocal pair of pseudorandom sequences. Accordingly, decorrelated signals 708 may be generated by a set of pseudorandom sequences, to provide a broad perception of spaciousness.

Figure 8:
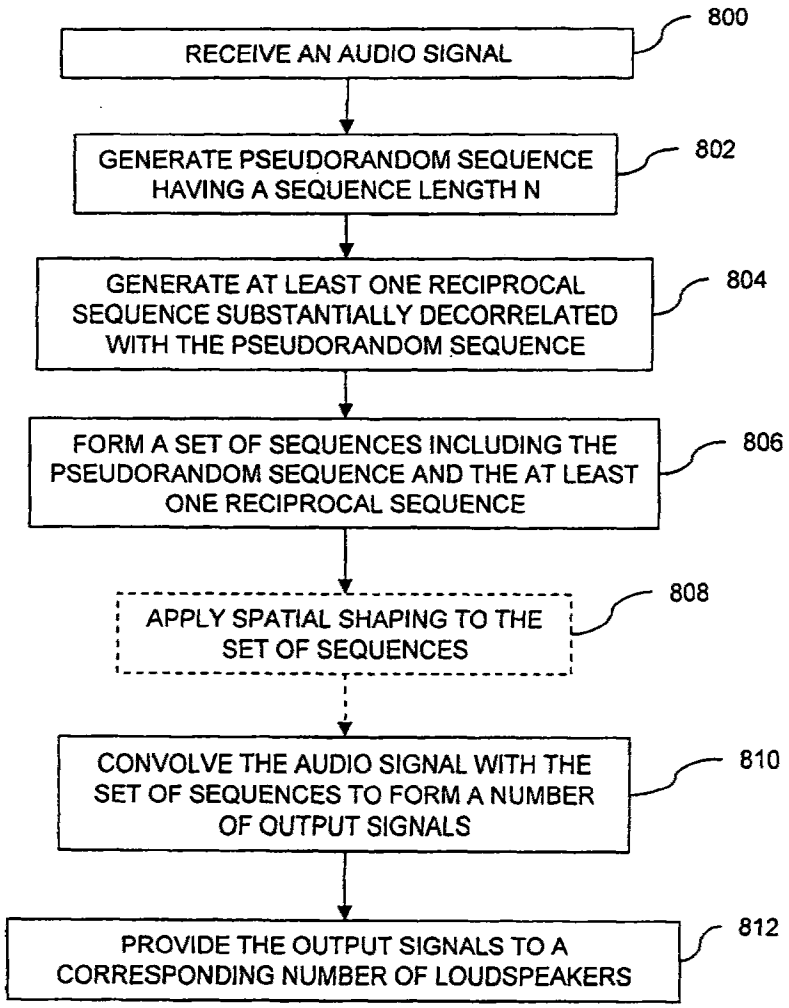
FIG. 8 is a flowchart illustrating an exemplary method for processing an audio signal, according to an embodiment of the present invention.

Referring to FIG. 8, an exemplary method for processing an audio signal is shown. At step 800, an audio signal is received, for example, audio signal X by signal decorrelator 114 (FIG. 1) of audio signal processing apparatus 102. At step 802, a pseudorandom sequence is generated having a sequence length N, for example, by coded sequence generator 112 (FIG. 1).

At step 804, at least one reciprocal pseudorandom sequence is generated, for example, by reciprocal sequence generator 502 (FIG. 5) of signal decorrelator 114. The reciprocal pseudorandom sequence is substantially decorrelated with the pseudorandom sequence. At step 806, a set of pseudorandom sequences is formed from the pseudorandom sequence and the reciprocal of the pseudorandom sequence, for example, by reciprocal sequence generator 502 (FIG. 5).

At optional step 808, spatial shaping may be applied to the set of pseudorandom sequences, for example, by spatial shaping generator 504 (FIG. 5). At step 810, the received audio signal is convolved with the set of pseudorandom in sequences (or the spatially shaped sequences generated at optional step 808) to form a corresponding number of output signals, for example, by convolver 506 (FIG. 5) of signal decorrelator 114. At step 812, the output signals are provided to a corresponding number of loudspeakers, for example, output signals Y are provided to loudspeakers 106 (FIG. 1).

Figure 9:
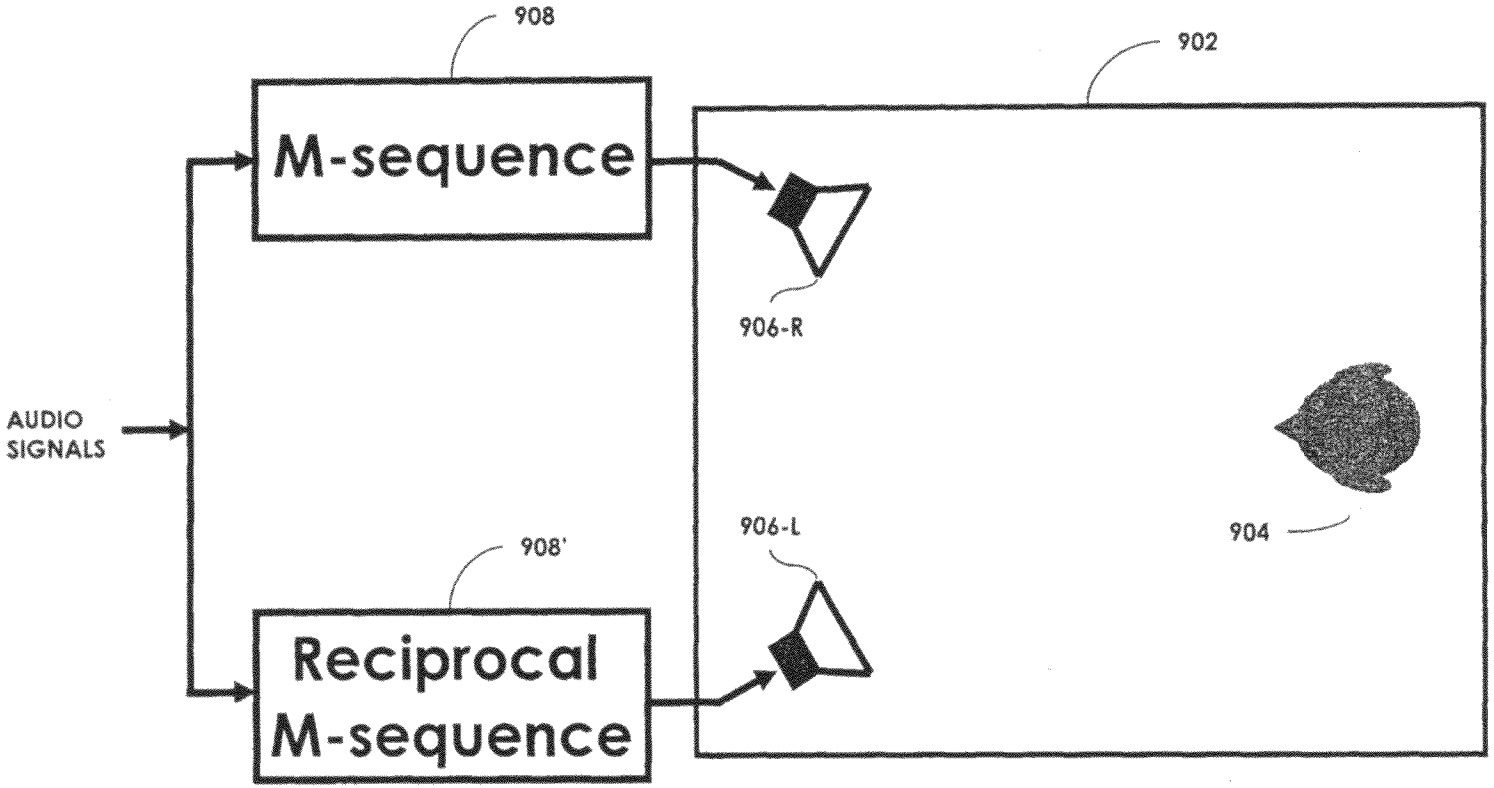
FIG. 9 is a functional block diagram illustrating an experimental setup for testing a spaciousness of audio signals decorrelated using an exemplary decorrelation method and a conventional decorrelation method.
Figure 10:
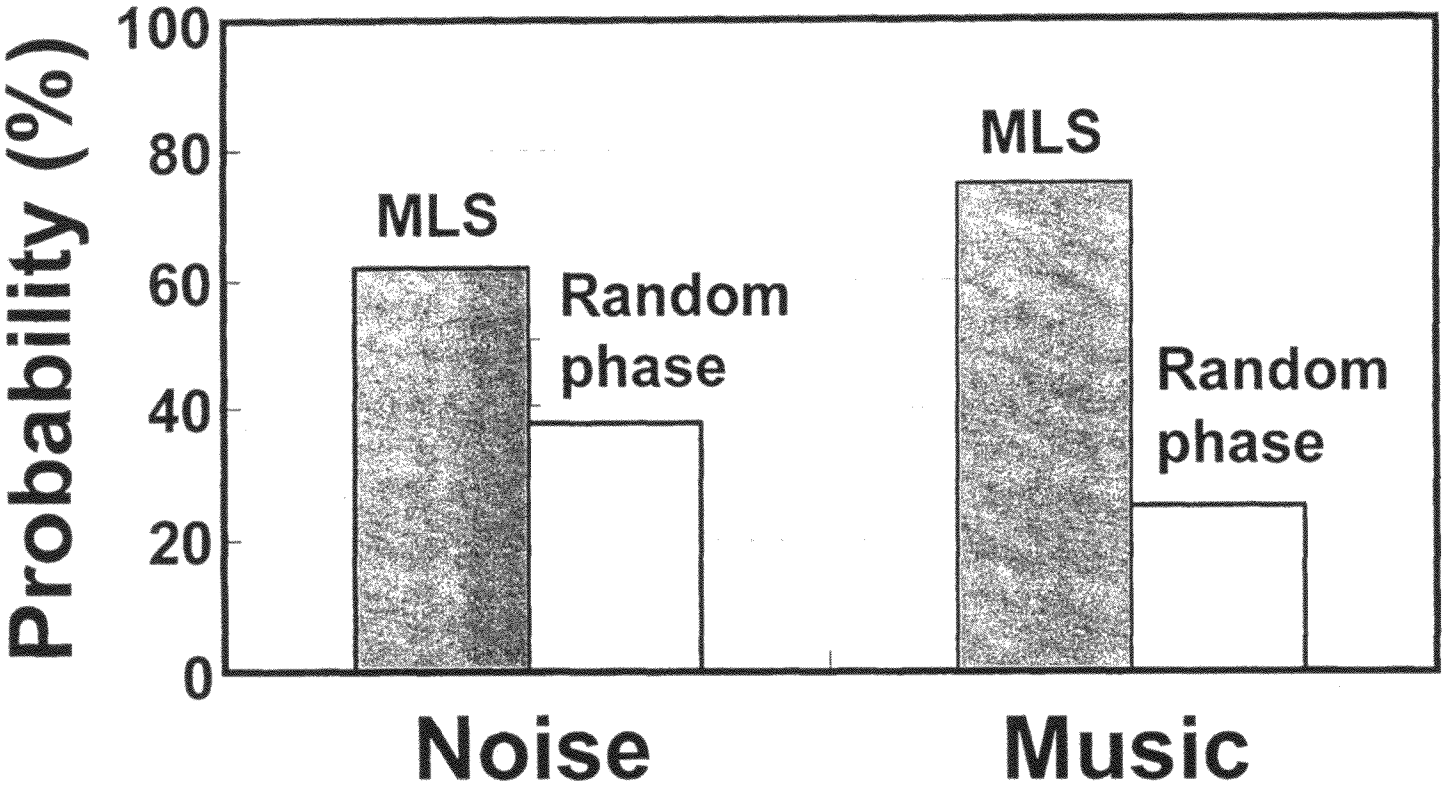
FIG. 10 is a graph of a probability of spaciousness for audio signals decorrelated using an exemplary decorrelation method and a conventional decorrelation method.

Referring next to FIGS. 9 and 10, a psychoacoustic test of spaciousness perception is described. In particular, FIG. 9 is a functional block diagram illustrating an experimental setup of listening room 902 for testing a spaciousness of decorrelated audio signals; and FIG. 10 is a graph of a probability of spaciousness for decorrelated audio signals using an exemplary reciprocal pair of MLSs and conventional random phase signals.

The test included using two loudspeakers 906-R, 906-L for providing decorrelated audio signals to subject 904 at a particular listening position. Loudspeakers 906-R, 906-L were arranged at +/−30 degrees towards subject 904. The audio signals included both music and noise. A total of ten subjects participated in the test. The audio signals were decorrelated using MLSs 908 with different sequence lengths and reciprocal MLSs 908'. The audio signals were modified by M- and reciprocal MLSs 908, 908' using FIR filtering. Various lengths of M- and reciprocal MLSs 908, 908' were examined. The audio signals were also decorrelated using conventional random phase signals.

As shown in FIG. 10, results for both noise and music indicated a higher perceived spaciousness as compared with conventional random phase signals. Among the sequence lengths tested, it was determined that lengths of 511, 1023, 2047 and 4095 provided a reasonable perception of spaciousness. Sequence lengths of 2047 and 4095 provided a higher perception of spaciousness as compared with lengths 511 and 1023. Accordingly, a most natural broadening of spatial events may be obtained by sequence lengths between 511 and 4095, more particularly at a sequence length of 2047.

Although the invention has been described in terms of systems and methods for processing an audio signal to provide plural decorrelated audio signals, it is contemplated that one or more components may be implemented in software on microprocessors/general purpose computers (not shown). In this embodiment, one or more of the functions of the various components may be implemented in software that controls a general purpose computer. This software may be embodied in a computer readable medium, for example, a magnetic or optical disk, or a memory-card.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A method of processing an audio signal, the method comprising:

generating a pseudorandom sequence;

generating at least one reciprocal of the pseudorandom sequence such that the at least one reciprocal is substantially decorrelated with the pseudorandom sequence, the pseudorandom sequence and the at least one reciprocal forming a set of sequences;

convolving the audio signal with each sequence in the set of sequences to generate a corresponding number of output signals; and providing the number of output signals to a corresponding number of loudspeakers.

2. The method according to claim 1, wherein the pseudorandom sequence includes at least one of a maximum-length sequence (MLS), a Gold sequence or a Kasami sequence.

3. The method according to claim 1, wherein the step of generating the pseudorandom sequence includes selecting a length of the pseudorandom sequence to adjust an amount of spaciousness of the set of sequences.

4. The method according to claim 1, wherein the step of generating the at least one reciprocal of the pseudorandom sequence includes forming a time-reverse of the pseudorandom sequence.

5. The method according to claim 1, wherein the step of generating the at least one reciprocal of the pseudorandom sequence includes decimating the pseudorandom sequence.

6. The method according to claim 1, further comprising, prior to the step of convolving, applying a spatial shaping to the set of sequences to form a set of spatially shaped sequences, wherein the audio signal is convolved with the set of spatially shaped sequences.

7. A tangible computer readable medium including computer program instructions configured to cause a computer to perform the method of claim 1.

8. An audio signal processing apparatus comprising:

a coded sequence generator configured to generate a pseudorandom sequence; and a signal decorrelator configured to generate at least one reciprocal of the pseudorandom sequence such that the at least one reciprocal is substantially decorrelated with the pseudorandom sequence, the pseudorandom sequence and the at least one reciprocal forming a set of sequences, the signal decorrelator convolving an audio signal by each sequence in the set of sequences to produce a corresponding number of output signals.

9. The audio signal processing apparatus according to claim 8, wherein the coded sequence generator includes a linear feedback shift-register.

10. The audio signal processing apparatus according to claim 8, wherein the pseudorandom sequence includes at least one of a maximum-length-sequence (MLS), a Gold sequence or a Kasami sequence.

11. The audio signal processing apparatus according to claim 10, wherein the pseudorandom sequence is the MLS and a sequence length of the MLS is between 511 and 4095.

12. The audio signal processing apparatus according to claim 8, wherein the number of output signals is provided to a corresponding number of loudspeakers.

13. The audio signal processing apparatus according to claim 8, further comprising:

a user interface configured to select a sequence length for the pseudorandom sequence.

14. The audio signal processing apparatus according to claim 8, wherein the signal decorrelator includes:

a reciprocal sequence generator configured to generate the at least one reciprocal of the pseudorandom sequence and to form the set of sequences; and a convolver configured to convolve the audio signal with the set of sequences to produce the number of output signals.

15. The audio signal processing apparatus according to claim 14, wherein the reciprocal sequence generator generates the at least one reciprocal of the pseudorandom sequence by at least one of forming a time-reverse of the pseudorandom sequence or decimating the pseudorandom sequence.

16. The audio signal processing apparatus according to claim 14, wherein the signal decorrelator further includes:

a spatial shaping generator configured to apply a spatial shaping to the set of sequences to form a set of spatially shaped sequences, wherein the convolver convolves the audio signal with the set of spatially shaped sequences.

17. A system for processing an audio signal comprising:

a decoder configured to receive an input audio signal and to generate at least three channels of output signals; and an audio signal processing apparatus configured to receive the input audio signal and to generate at least two pseudorandom sequences that are substantially decorrelated with each other, the audio signal processing apparatus modifying the input audio signal by the at least two pseudorandom sequences to produce at least two decorrelated signals, wherein the audio signal processing apparatus comprises:

a coded sequence generator configured to generate a first sequence of the at least two pseudorandom sequences, and a signal decorrelator configured to generate remaining sequences of the at least two pseudorandom sequences, the remaining sequences generated as reciprocals of the first sequence.

18. The system according to claim 17, wherein each pseudorandom sequence includes at least one of a maximum-length-sequence (MLS), a Gold sequence or a Kasami sequence.

19. The system according to claim 17, wherein the signal decorrelator includes:

a reciprocal sequence generator configured to generate the remaining sequences; and a convolver configured to convolve the input audio signal with the at least two pseudorandom sequences to produce the at least two decorrelated signals.

* * * * *